US007219872B2

(12) United States Patent
Walker

(10) Patent No.: US 7,219,872 B2
(45) Date of Patent: May 22, 2007

(54) ADJUSTABLE POST SUPPORT

(75) Inventor: Simon Walker, Surrey (CA)

(73) Assignee: Peak Innovations Inc., Richmond (CA)

( * ) Notice: Subject to any disclaimer, the term of this patent is extended or adjusted under 35 U.S.C. 154(b) by 67 days.

(21) Appl. No.: 10/551,761

(22) PCT Filed: Apr. 9, 2003

(86) PCT No.: PCT/CA03/00525

§ 371 (c)(1),
(2), (4) Date: Oct. 3, 2005

(87) PCT Pub. No.: WO2004/090264

PCT Pub. Date: Oct. 21, 2004

(65) Prior Publication Data

US 2006/0278772 A1 Dec. 14, 2006

(51) Int. Cl.
*F16M 13/00* (2006.01)

(52) U.S. Cl. ..... 248/516; 248/156; 248/530; 248/545

(58) Field of Classification Search ..... 248/516, 248/545, 156, 530, 532, 507; 52/165
See application file for complete search history.

(56) References Cited

U.S. PATENT DOCUMENTS 2,706,967 A 4/1955 Iannetti
2,806,289 A * 9/1957 Rongaus et al. ..... 248/516
3,204,898 A * 9/1965 Manning ..... 248/516
4,249,715 A 2/1981 Repp
4,588,157 A 5/1986 Mills
4,778,142 A 10/1988 Roba
4,874,149 A 10/1989 Miceli
5,404,682 A * 4/1995 West ..... 52/165
5,884,874 A * 3/1999 Speece et al. ..... 248/516
5,927,677 A * 7/1999 Speece et al. ..... 248/516
6,273,390 B1 8/2001 Meyer
6,308,926 B1 * 10/2001 Meyer ..... 248/530

FOREIGN PATENT DOCUMENTS

DE 295 19 676 2/1996
EP 657604 * 6/1995
GB 2 111 553 7/1983

* cited by examiner

*Primary Examiner*—Ramon O Ramirez
(74) *Attorney, Agent, or Firm*—Mark Hopkinson

(57) ABSTRACT

An adjustable post support (10) for use in supporting a post vertically above the ground. The support may include a lower spike portion (12) and an upper bracket portion (14). The lower spike portion may include an upper end. The bracket portion may include a curved dome (22) and an upstanding sleeve (32) extending upwardly therefrom. The curved dome may nest with the upper end of the spike to provide a ball and socket type connection between the lower spike portion and the upper bracket portion. A fastening device (52, 54) may be used for tightening the upper bracket and lower spike portion together and a support table (60) may be located inside the sleeve.

21 Claims, 7 Drawing Sheets

ADJUSTABLE POST SUPPORT

FIELD OF THE INVENTION

The invention relates to the field of structural supports and in particular to an adjustable post support.

BACKGROUND OF THE INVENTION

Generally, fence posts are held in position by digging a large opening in the ground, filling the opening with concrete and before the concrete has an opportunity to set, locating the bottom end of the fence post in the concrete.

The above process is very labor intensive and requires special working tools such as augers and the like for digging the ground out to receive the concrete base for the post.

Attempts have been made to make it easier to embed the base of a fence post or any other type of ground support post. For example, U.S. Pat. No. 2,706,967 discloses an anchoring stake having a ground engaging spike with a movable pin extending therefrom. The pin has a pivot ball on one end with a registering fitting secured to the spike. A lead ring is formed on the pin opposite end to which a pet lead can be attached.

U.S. Pat. No. 4,249,715 discloses a sign supporting apparatus having a ground engaging portion and an integral support post and end cap arm support from which a sign can be hung. The support post is slid up and down on the upstanding ground engagement portion of the device driving same downwardly into the ground. The end cap support arm for the sign is then inserted to the upstanding post portion.

U.S. Pat. No. 4,588,157 is directed to a post support having a ground engagement portion and an integral post receiving portion extending therefrom. The post receiving portion has a plurality of locking tabs within that wedgeably secure the post positioned within.

U.S. Pat. No. 4,778,142 shows an awning anchor having a ground engagement screw portion and a pivoted awning arm mount extending therefrom.

U.S. Pat. No. 4,874,149 discloses a fence post holder having a bottom spike which is embedded into a ground supporting surface with a bracket fixed to the top of the spike for receiving the base of a fence post.

Although the spikes disclosed above can easily be driven into the ground, such spikes may be driven at something other than a vertical angle. This may be unavoidable because of a number of factors including, the slope of the ground surface, underground impediments, such as rocks, which may deflect the spike, or simply through misjudgment by the person embedding the spike. As a result, the fence-post supported atop the spike may extend upwardly at a skewed angle from vertical. This is particularly noticeable for relatively tall fence posts, and adversely affects the overall construction of the fencing supported by such posts.

Many have attempted to overcome the drawbacks noted immediately above. For example, U.S. Pat. No. 5,884,874 discloses a post support with a lower spike portion and an upper bracket portion. However, unlike the earlier construction in the '149 patent, the bracket portion in the '874 patent is adjustable relative to the spike portion. This allows for upright positioning of the fence post even if the spike portion is not driven vertically into the ground.

U.S. Pat. No. 5,927,677 discloses a similar post support to that disclosed in the '874 patent and includes post stop tabs extending within a sleeve in spaced relation to a fixation fastener.

U.S. Pat. No. 6,273,390 discloses a post holder formed by a lower spike portion and an upper bracket portion; the bracket portion being connected to the spike portion at an adjustable connection formed by a curved seat at the upper end of the spike portion and a curved base at the bottom end of the bracket portion.

European Pat No. EP0657604 discloses a post engagement portion having a contoured swivel base which is registerable on a secondary swivel base secured to a ground engagement portion. The two contoured surfaces are interengaged and held to one another by a pair of oppositely disposed fasteners extending through elongated slots in the respective base portion to allow for the angle orientation of the top portion.

Although the device disclosed in European Pat No. EP0657604 allows for the angle orientation of a top portion, no device is provided to elevate the fence post away from the pair of oppositely disposed fasteners extending through elongated slots in the respective base portion.

In the '874 patent, the spike portion has a flat upper surface which receives a curved lower surface on the bracket portion. This connection is what allows adjustment of the bracket portion. However, because the two surfaces do not properly mate with one another, it is essentially impossible to secure them with one another in a manner which precludes undesirable deflection of the bracket portion when it is subjected to load applied to it by the fence post.

In the '677 patent, the post stop tabs are used to support the fence post away from fastening means within the sleeve. However, such tabs may be susceptible to bending while the fence post is within the sleeve, ultimately defeating their intended purpose.

In the '390 patent, the curved seat at the upper end of the spike portion and the curved base at the bottom end of the bracket portion curve downwardly and towards the lower spike portion. Because of this curvature, moisture may pool at the bottom of the respective curved bases which could adversely affect the functionality of the device.

Accordingly, a need exists for an improved post support providing ease in installation, and which overcomes the deficiencies noted above. Other objects of the invention will be apparent from the description that follows.

SUMMARY OF THE INVENTION

According to one aspect of the present invention there is provided an adjustable post support for supporting a post above the ground. The support may include a lower spike portion and an upper bracket portion. The lower spike portion may include an upper end with a first curved dome. The bracket portion may include a second curved dome corresponding to the first curved dome and an upstanding sleeve extending upwardly therefrom. The first and second domes may nest with one another to provide a ball and socket type connection between the lower spike portion and the upper bracket portion. A fastening device may be used for tightening the first and second domes together and a support table may be located inside the sleeve.

The first and second curved domes may each curve outwardly and away from the lower spike portion and may each define a central opening for the fastening device to fit through. The fastening device may include a threaded nut and a threaded bolt which fits through the central openings in the domes.

At least one wall of the sleeve may define a slot adjacent the second curved dome.

The spike portion may be a plurality of spike blades joined centrally of the spike portion with one another.

The sleeve may include upstanding walls. The support table may include a support face oriented substantially perpendicular to the walls of the sleeve and a support member extending substantially perpendicularly from the support face towards the second curved dome. The support table may be above the fastening device and each of the central openings of each of the curved domes. The support table may include a central opening above the fastening device.

The post support may further include at least one pair of opposed, parallel and spaced flanges extending outwardly from an adjacent pair of side walls of the sleeve, the flanges being adapted to be drawn toward one another.

In another aspect of the present invention there is provided an adjustable post support for use in supporting a post vertically above the ground. The support may include a lower spike portion and an upper bracket portion. The lower spike portion may include an upper end. The bracket portion may include a curved dome and an upstanding sleeve extending upwardly therefrom. The curved dome may nest with the upper end of the spike to provide a ball and socket type connection between the lower spike portion and the upper bracket portion. A fastening device may be used for tightening the upper bracket and lower spike portion together and a support table may be located inside the sleeve.

Other aspects of the invention will be appreciated by reference to the detailed description of the preferred embodiment and to the claims that follow.

BRIEF DESCRIPTION OF THE DRAWINGS

The preferred embodiment of the invention will be described by reference to the drawings thereof in which.

DESCRIPTION OF THE PREFERRED EMBODIMENT OF THE INVENTION

Figure 1:
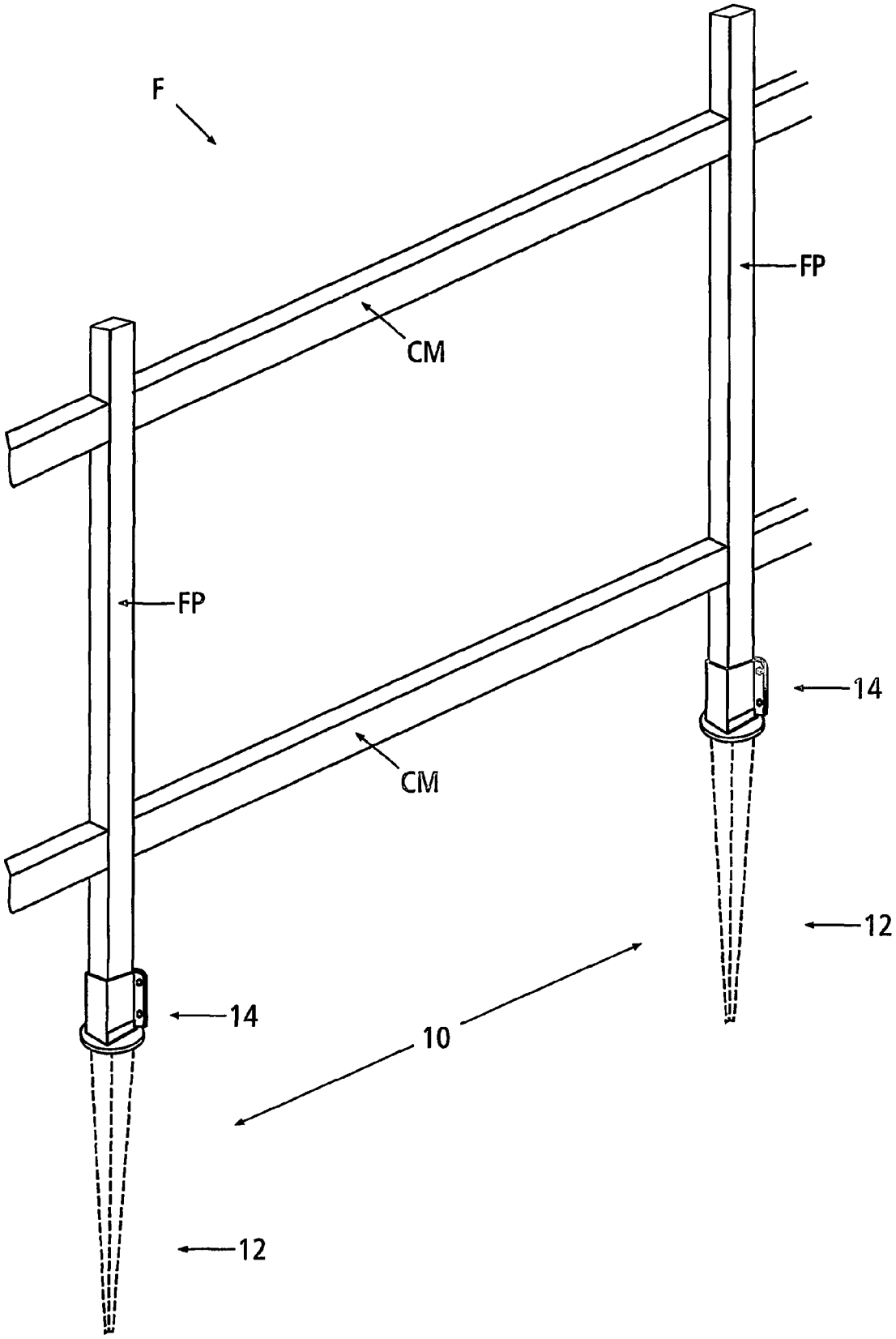
FIG. 1 is a perspective view of a part of a fence including upright fence posts secured in position by fence post supports made in accordance with a first embodiment of the present invention.

FIG. 1 shows a section of a fence generally indicated at F. This fence is formed by a pair of cross members CM held in position by upright fence posts FP. The fence posts are secured to a ground supporting surface by means of adjustable post supports generally indicated at 10.

The adjustable post supports 10 are formed by a lower spike portion generally indicated at 12 and an upper bracket portion generally indicated at 14. Spike portion 12 embeds into the ground and bracket portion 14 sits above ground level for receiving the bottom end of any one of the fence posts FP.

Figure 2:
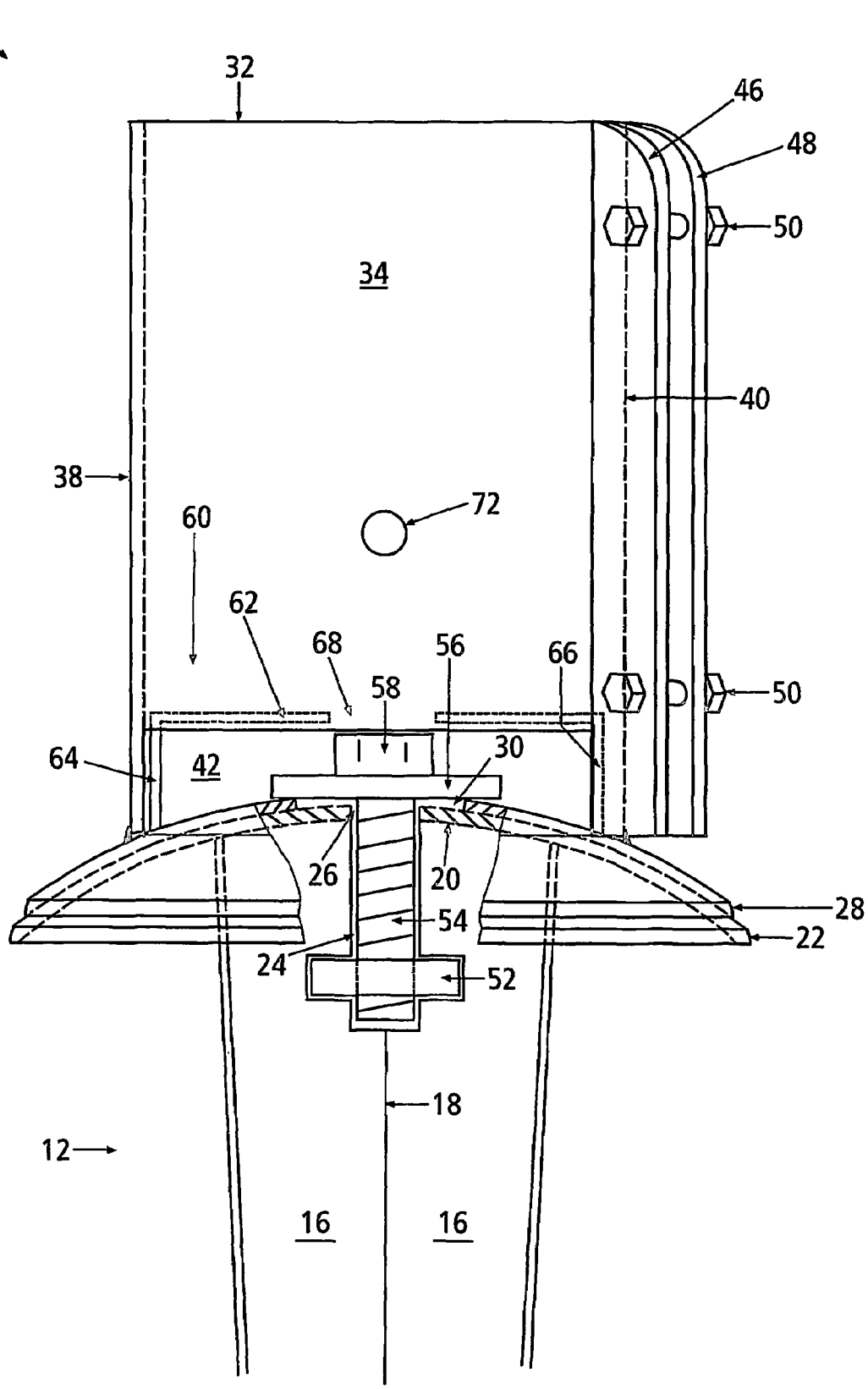
FIG. 2 is a partial cut-away view of the connection region between an upper bracket portion and a lower spike portion of the post support of FIG. 1.
Figure 3:
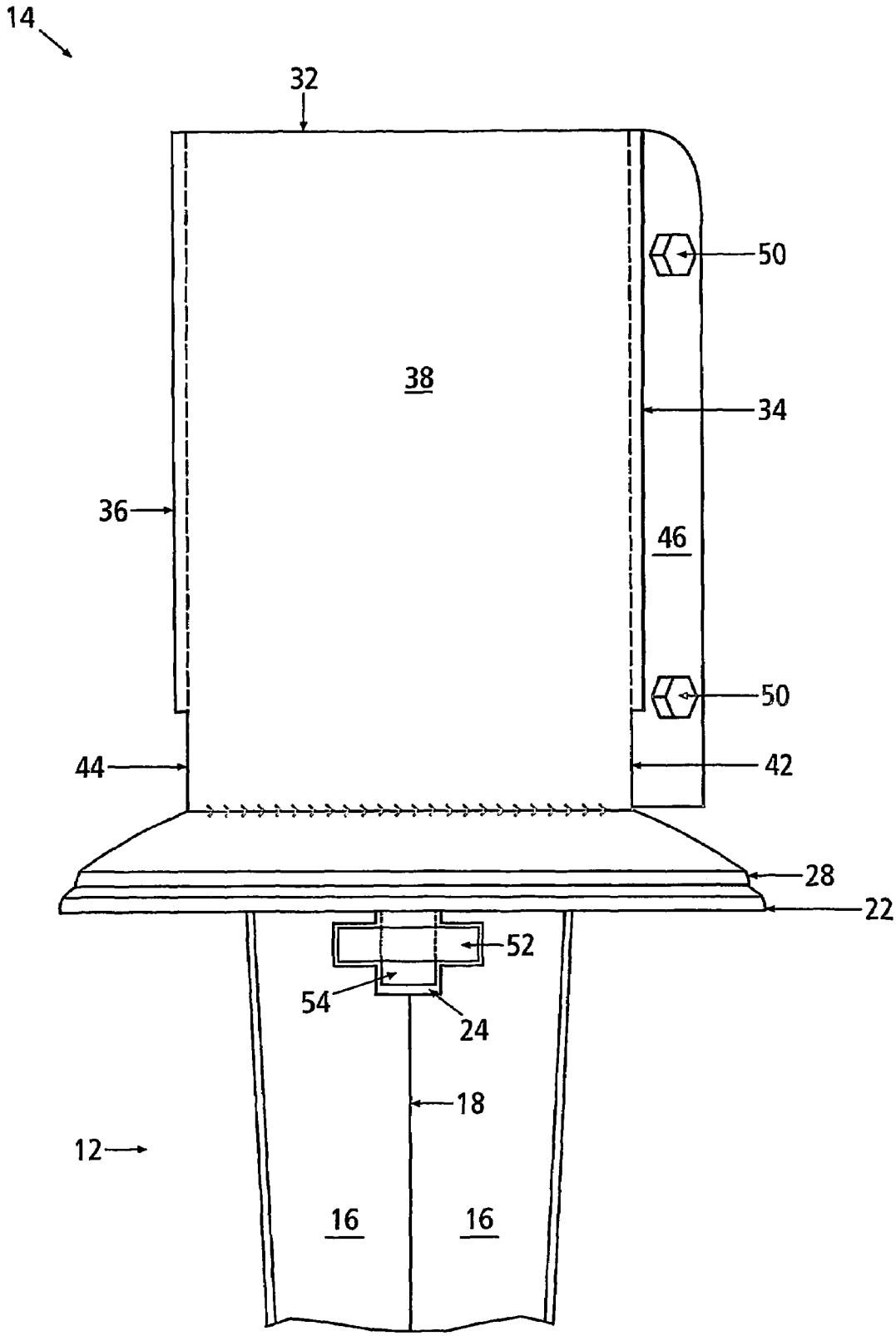
FIG. 3 is a side plan view of the post support of FIG. 2.
Figure 7:
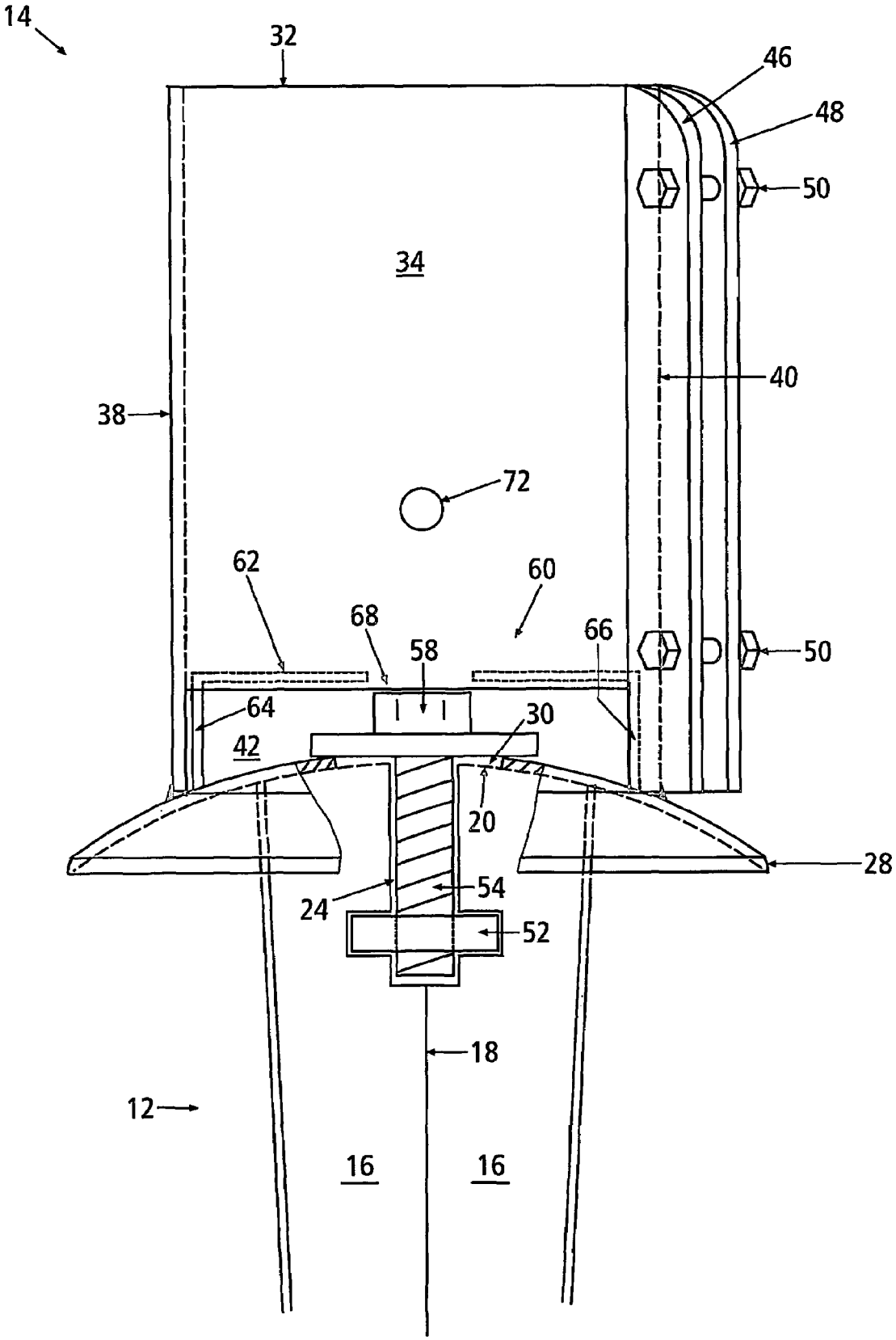
FIG. 7 is a partial cut-away view of a second embodiment of the connection region between an upper bracket portion and a lower spike portion of the post support of FIG. 1.

Referring to FIGS. 2-3 and 7, the spike portion 12 is formed by a plurality of tines or blades 16 which join centrally of the spike portion as indicated at 18 and diverge outwardly from their central connection. In the present embodiment, blades 16 may be formed by separate blades welded together at the central connection 18 or the blades may be formed from a unitary structure.

Each of the blades 16 has an upper end 20. Preferably, as illustrated in FIGS. 2-3, the upper end 20 is secured to a lower dome 22. A recess 24 is formed by the plurality of blades 16 adjacent the upper portion of the lower spike 12 and directly below the upper end 20. The lower dome 22 curves upwardly and outwardly away from the recess 24 and includes a central opening 26 which aligns with the recess.

The upper bracket portion 14 includes an upper dome generally indicated at 28. The upper dome 28 has a corresponding curvature to the lower dome 22 and also includes a central opening 30. Accordingly, the upper dome 28 and lower dome 22 interfit in a ball and socket type manner with one another.

As illustrated in FIG. 7, in another embodiment, the upper dome 28 may simply interfit in a ball and socket type manner with the upper end 20 of the lower spike portion 12 without the benefit of the lower dome 22. In such an embodiment, as those skilled in the art will appreciate, the upper dome 28 will be curved to allow it to slidably move across the upper end 20 of the lower spike 12. The upper end 20, in this instance may also be formed to facilitate the movement of the upper dome 22.

Figure 4:
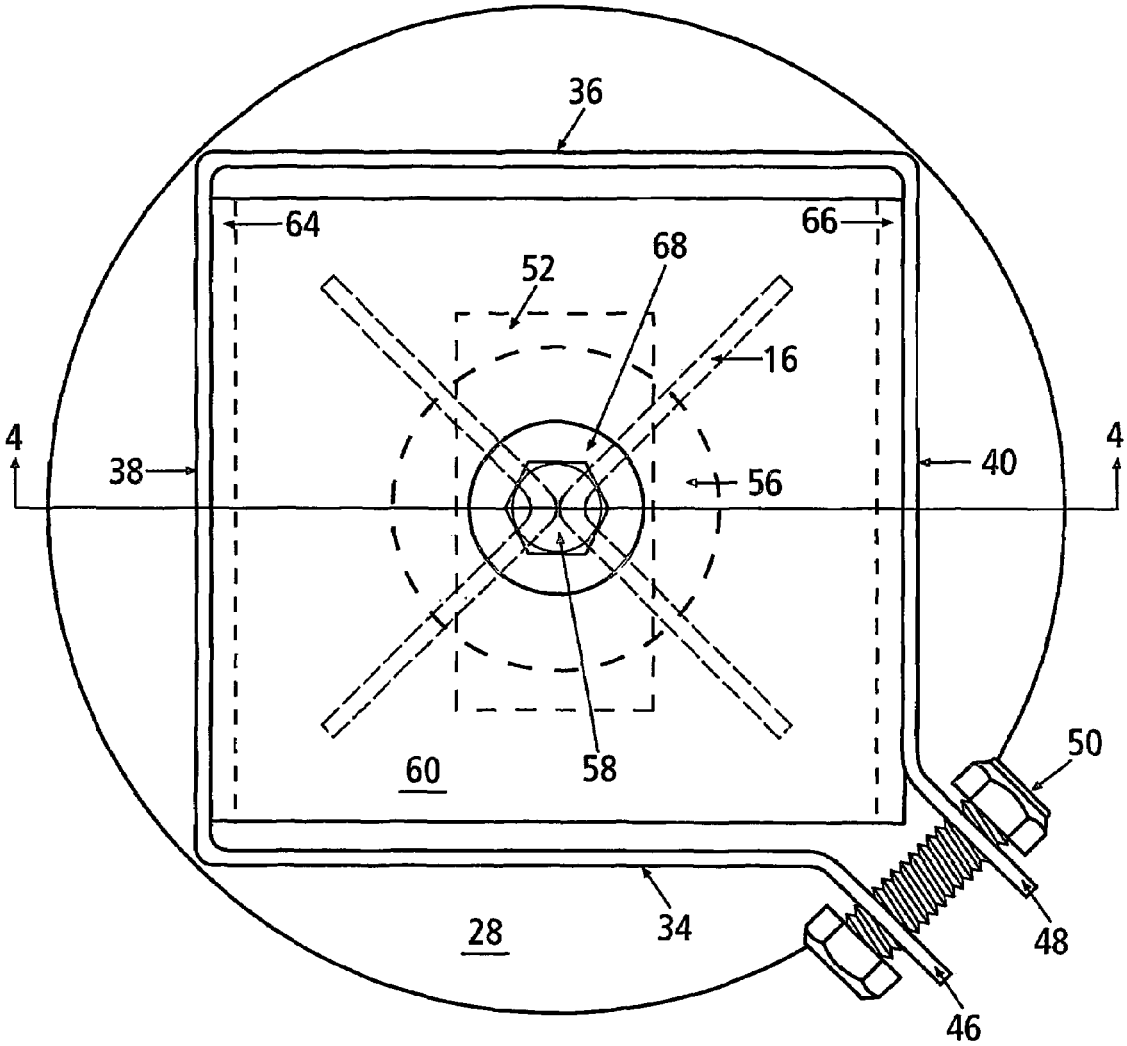
FIG. 4 is a top plan view of the post support of FIG. 2.

Referring to FIGS. 2-4, the upper bracket portion 14 also includes an upstanding sleeve 32 connected to the upper dome 28. The sleeve 32 includes a plurality of side walls; in this embodiment, four side walls 34, 36, 38 and 40, which are preferably welded to the upper dome 28 in an upstanding vertically aligned fashion. As those skilled in the art will appreciate, the sleeve 32 is not limited to four side walls and may in fact be comprised of an infinite number; that is, a sleeve circular in cross-section as viewed from above. Side walls 34 and 36 include slots 42 and 44, respectively, the purpose of which will be described in detail later. Preferably, the sleeve 32 is formed from a single piece of metal rather than being formed separately then welded, so as to minimize the risk of failure of such welds.

Walls 34 and 40 further comprise flange portions 46 and 48 respectively, extending diagonally outward from a corner of the sleeve 32, substantially parallel to each other. Bolts 50 or the like may be inserted through holes (not shown) in each of flange portions 46 and 48. Bolts 50 may be tightened so as to reduce the cross sectional size of the sleeve 32, thereby holding a post firmly in place inside the sleeve. It will also be appreciated that as a result of this flange tightening arrangement, side wall 34 strictly speaking does not extend between side wall 38 and side wall 40 but more precisely it extends between side wall 38 and the flanged opening between side wall 34 and side wall 40.

The size of the sleeve 32, and the post support as a whole, may be varied in order to accommodate different standard sizes of dimensioned lumber. Preferably, the spacing between walls 34 and 36 and between walls 38 and 40 is chosen to correspond to standard widths of cut lumber, for example 3 and ½ inches to accommodate 4"×4" lumber in the sleeve.

Fastening means are provided to fasten the top bracket 14 and lower spike portion 12 together. As those skilled in the art will appreciate, fastening means may include clamps, pins, and locking bars. Preferably, the fastening means includes a nut and bolt combination. In particular, the nut and bolt combination includes a nut 52 which locks against rotation in the recess 24 at the upper end of the spike portion 12, and a bolt 54. The bolt 54 fits through a lock washer 56, the central opening 30 in the upper dome 28, the central opening 26 in the lower dome 22, and into the nut 52. The bolt head 58 is exposed for tightening the bolt 54 with the nut 52 while the bottom end of the fence post is in the bracket portion 14.

Preferably, to provide support for the nut 52 and to prevent the nut from shifting from side-to side when in place, the central opening 26 of the lower dome 22 and/or recess 24 may be dimensioned to be just large enough to enable the nut to fit through.

The central opening 30 of the upper dome 28 is preferably dimensioned to provide the upper dome with the greatest degree of movement as it is slidably moved across the plane of the lower dome 22, or upper end 20 as the case may be, while the bolt 54 is in place. As such, lock washer 56 is preferably dimensioned to cover the central opening 30 of the upper dome 28 as the upper dome is slidably moved along its entire range of motion.

As noted above, nut 52 is locked against rotation in recess 24 because of the abutment of the shoulders of the nut with the interior faces of the blades 16 around the recess 24. Accordingly, the nut 52 will not turn as bolt 54 is threaded into the nut by a tool for tightening the connection between the bracket portion 14 and the spike portion 12.

Figure 5:
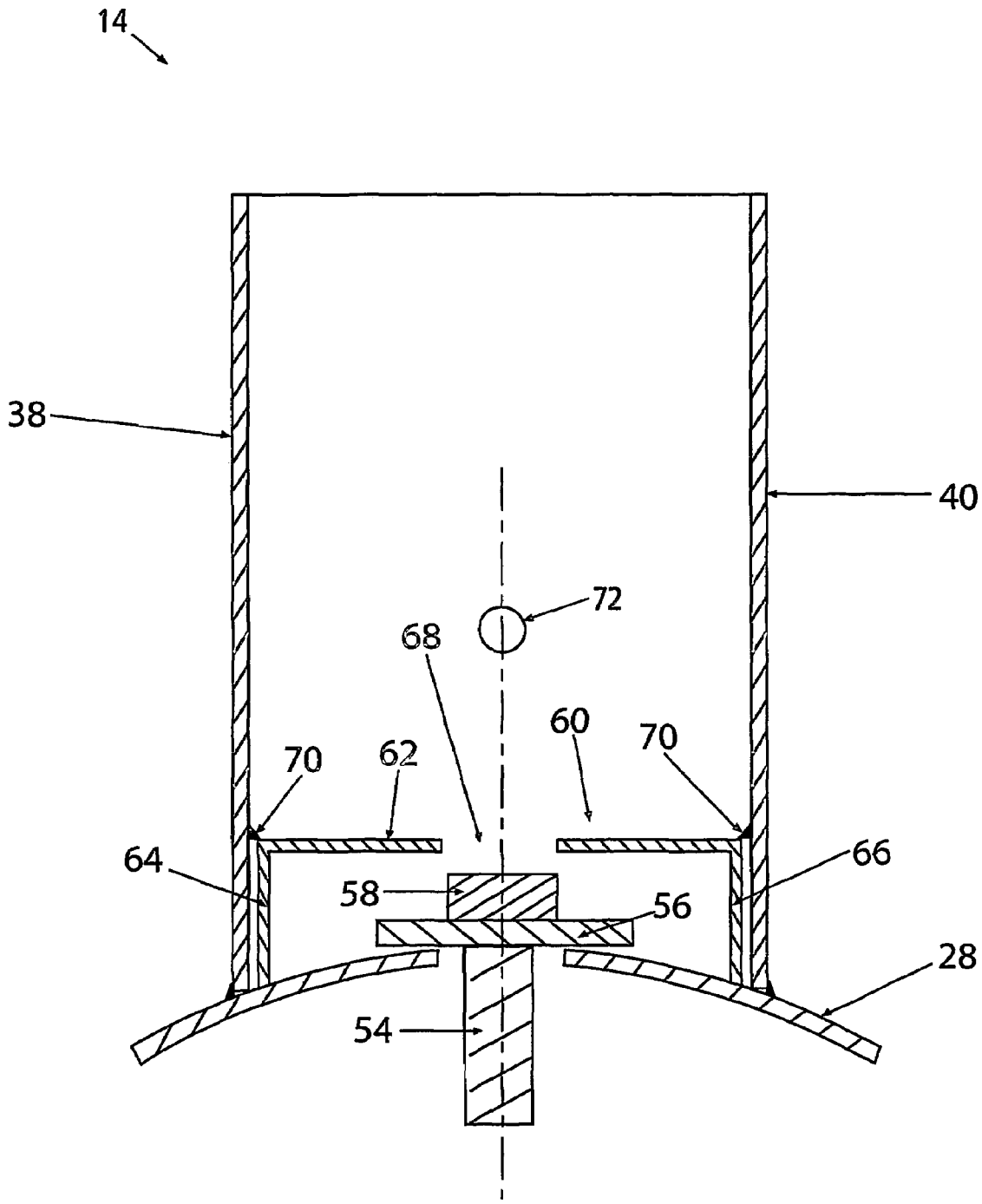
FIG. 5 is a cross-sectional view of the top bracket and fastening device of the post support along line 4-4 of FIG. 4.
Figure 6:
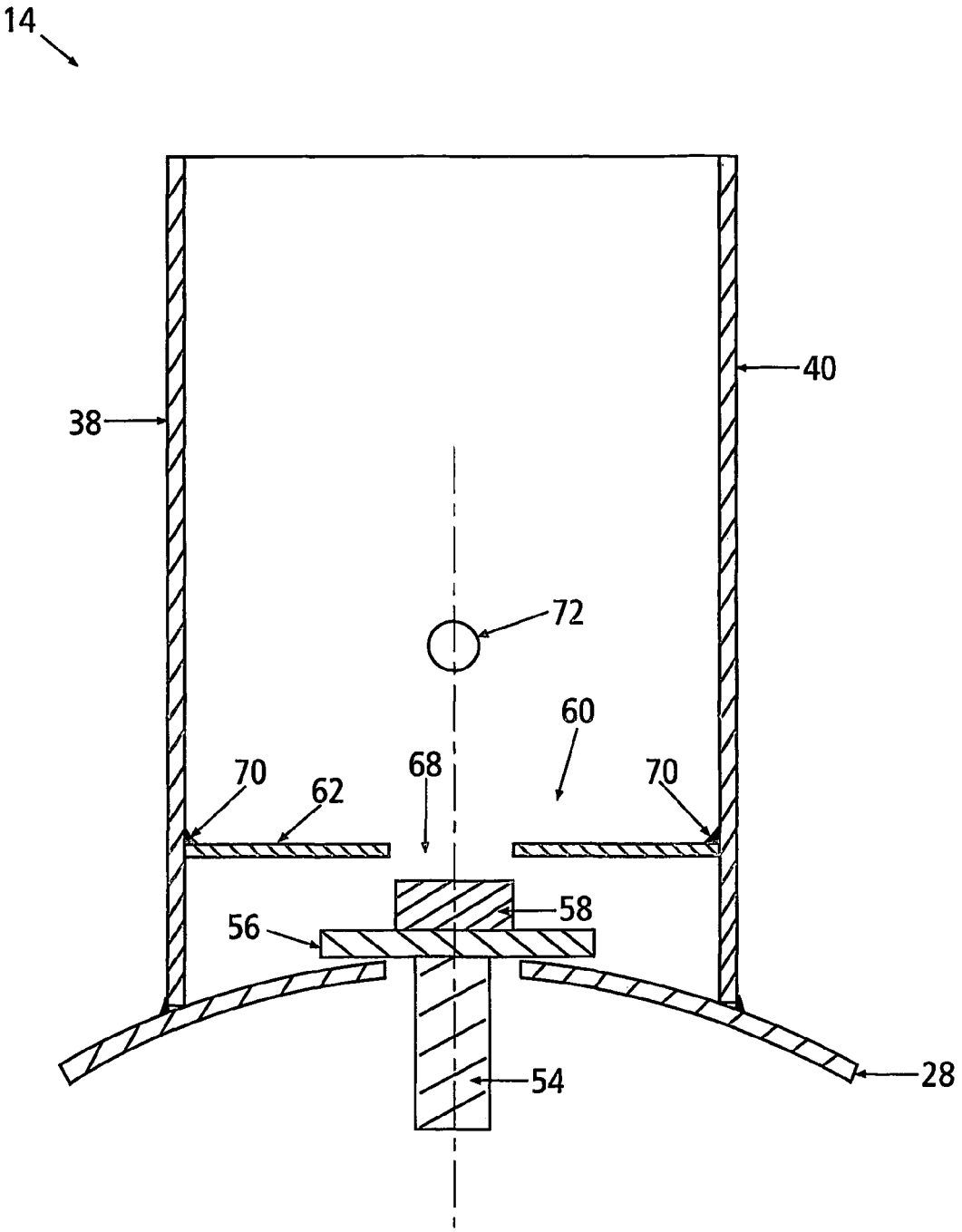
FIG. 6 is a cross-sectional view of an alternative embodiment of the top bracket and fastening device of the post support along line 4-4 of FIG. 4.

Referring to FIGS. 5 & 6, to support the fence post in the sleeve 32 away from bolt head 58, the sleeve includes a support table 60. The support table 60 has a support face 62 which is oriented substantially perpendicular to the side walls 34, 36, 38 and 40 and is preferably dimensioned to fit substantially across the sleeve 32 to prevent the support table from shifting within the sleeve.

The support face 62 may simply be a piece welded within the side walls 34, 36, 38 and 40, as illustrated in FIG. 6. To provide support to the support face 62, the support face preferably includes support members 64 and 66 extending substantially perpendicularly therefrom. In this embodiment, when the support table 60 is inserted into the sleeve 32, the support members 64 and 66 may frictionally engage the side walls 38 and 40, respectively. As such, support table 60, when placed properly, will be retained at the bottom of the bracket 14. To increase the frictional engagement, the support members 64 and 66 may be pulled away from one-another before the support table 60 is inserted into the sleeve 32. Spot welds 70 may also be used to further secure the support table 60 inside the bracket 14. As those skilled in the art will appreciate, the exact dimensions of the support table may be altered to accommodate various sized fence posts and may not necessarily be held in place inside the bracket 14.

Support members 64 and 66 are preferably dimensioned to support the support face 62 just above the bolt head 58. Support table 60 includes a central opening 5 which is preferably dimensioned to allow a user access with a tool, for example, a ratchet wrench, to the bolt head 58. During fabrication of the support post 10, the central opening 68 may also be accessed to install the bolt 54. Preferably, support table 60 is formed from a single piece of metal rather than being formed separately.

Other means of supporting the fence post in the sleeve 32 away from bolt head 58 are contemplated. For example, a shelf may be built inside sleeve 32 along the inside of side walls 34, 36, 38 and 40. The shelf may be integrally formed with the side walls or may be welded to them. Alternatively, a through bolt may be inserted through hole 70 extending through side walls 34 and 36.

Operation

To drive the post support 10 into ground, a user simply places a short piece of lumber into the sleeve 32 of the upper bracket 14. Because the post support 10 is used in the construction of fences, decks and the like, a plentiful supply of such lumber should be available for use in driving the post support into the ground. After the post support 10 has been put in place, the lumber used to drive in the post support may be used in construction of the intended structure, burned or otherwise disposed of.

When the spike 12 is embedded into the ground with its axis being angled off from vertical, the fence post needs to be axially off-set from the spike in order to have the fence post sit perfectly vertically. This is achieved by angling the bracket 14 portion relative to the spike portion 12 such that the bracket itself is completely vertical. According to the present invention, such an adjustment is easily accomplished as a result of the above described ball and socket type connection, i.e. the connection between the upper dome 28 of the bracket 14 with the lower dome 22 or upper end 20 of the spike portion 12, as the case may be.

With respect to the embodiment which utilizes a lower dome, regardless of the amount of adjustment between the two domes, there is always a substantial surface contact area between the two of them. This large surface contact area ensures a very large frictional engagement between the two domes once the nut and bolt fastener has been tightly secured into position. This further ensures that the bracket 14 portion will maintain its vertical orientation even under heavy load on the fence post.

Once a desired angle has been achieved, normally a true vertical alignment of the post within the sleeve 32, a user inserts a tool through slot 42 or 44, whichever slot is more easily accessible, and tightens bolt 54 down against the upper dome 28. Alternatively, before the fence post is inserted into the sleeve 32, the user may access the bolt 54 via central opening 68 of table support 60.

It will be evident from the above description that with the lower spike portion 12 driven into the ground the upper bracket 14 can be positioned vertically as desired by the adjusting the upper dome 28. The upper dome 28 which is slidably movable over the lower dome 22 or upper end 20, as hereinbefore described, is locked into place by tightening the bolt 54 using a tool which is inserted through slot 42 of side wall 34, or slot 44 of side wall 36, or through central opening 68 of support table 60. It will thus be seen that a new and novel adjustable fence post anchor has been illustrated and described and it will be apparent to those skilled in the art that various changes and modifications may be made therein without departing from the spirit of the invention.

What is claimed is:

1. An adjustable post support for supporting a post above the ground comprising:

a lower spike portion and an upper bracket portion, said lower spike portion comprising an upper end with a first curved dome, said bracket portion comprising a second curved dome corresponding to said first curved dome and an upstanding sleeve extending upwardly therefrom, said first and second domes nesting with one another to provide a ball and socket type connection between said lower spike portion and said upper bracket portion;

fastening means for tightening of said first and second domes together; and a support table inside said sleeve.

2. The post support of claim 1 wherein said sleeve comprises upstanding side walls and said support table comprises a support face oriented substantially perpendicular to said walls and a support member extending substantially perpendicularly from said support face towards said second curved dome.

3. The post support of claim 1 wherein said first and second curved domes curve outwardly and away from said spike portion.

4. The post support of claim 1 wherein said first and second curved domes each include a central opening.

5. The post support of claim 4 wherein said fastening means fits through said central openings of said first and second domes.

6. The post support of claim 5 wherein said support table is above said fastening means and each of said central openings of said first and second domes.

7. The post support of claim 4 wherein said support table is above each of said central openings of said first and second domes.

8. The post support of claim 1 wherein said support table includes a central opening.

9. The post support of claim 1 wherein at least one of said walls of said sleeve defines a slot adjacent said second curved dome.

10. The post support of claim 1 wherein said spike portion comprises a plurality of spike blades joined centrally of said spike portion with one another.

11. The post support of claim 1 wherein said fastening means comprises a threaded nut and a threaded bolt.

12. An adjustable post support for supporting a post above the ground comprising:

a lower spike portion and an upper bracket portion, said lower spike portion comprising an upper end with a first curved dome, said bracket portion comprising a second curved dome corresponding to said first curved dome and an upstanding sleeve extending upwardly therefrom, said first and second domes nesting with one another to provide a ball and socket type connection between said lower spike portion and said upper bracket portion;

fastening means for tightening of said first and second domes together;

a support table inside said sleeve; and at least one pair of opposed, parallel and spaced flanges extending outwardly from an adjacent pair of side walls of said sleeve, said flanges being adapted to be drawn toward one another.

13. The post support of claim 12 wherein said first and second curved domes curve outwardly and away from said spike portion.

14. The post support of claim 12 wherein said first and second curved domes each include a central opening.

15. The post support of claim 14 wherein said fastening means fits through said central openings of said first and second domes.

16. The post support of claim 12 wherein at least one of said walls of said sleeve defines a slot adjacent said second curved dome.

17. The post support of claim 12 wherein said spike portion comprises a plurality of spike blades joined centrally of said spike portion with one another.

18. The post support of claim 12 wherein said fastening means comprises a threaded nut and a threaded bolt.

19. An adjustable post support for supporting a post above the ground comprising:

a lower spike portion and an upper bracket portion, said lower spike portion having an upper end with a first curved dome, said bracket portion having a second curved dome corresponding to said first curved dome and an upstanding sleeve extending upwardly therefrom, said first and second domes nesting with one another to provide a ball and socket type connection between said lower spike portion and said upper bracket portion;

fastening means for tightening of said first and second domes together; and a support table inside said sleeve, said support table comprising a support face oriented substantially perpendicular to walls of said sleeve and a support member extending substantially perpendicularly from said support face towards said second curved dome.

20. An adjustable post support for supporting a post above the ground comprising: a lower spike portion and an upper bracket portion, said lower spike portion comprising an upper end, said bracket portion comprising a curved dome and an upstanding sleeve extending upwardly therefrom, said curved dome nesting with said upper end of said lower spike portion to provide a ball and socket type connection between said lower spike portion and said upper bracket portion; fastening means for tightening of said upper bracket and lower spike portion together; and a support table inside said sleeve.

21. A kit for supporting a post above the ground, said kit comprising:

a lower spike portion and an upper bracket portion, said lower spike portion comprising an upper end, said bracket portion comprising a curved dome and an upstanding sleeve extending upwardly therefrom, said curved dome adapted to nest with said upper end of said lower spike portion to provide a ball and socket type connection between said lower spike portion and said upper bracket portion;

fastening means for tightening of said upper bracket sand lower spike portion together; and a support table inside said sleeve.

* * * * *